US010166801B2

(12) United States Patent
Stowe

(10) Patent No.: US 10,166,801 B2
(45) **Date of Patent: *Jan. 1, 2019**

(54) SINGLE PASS IMAGING USING RAPIDLY ADDRESSABLE LASER LAMINATION

(71) Applicant: PALO ALTO RESEARCH CENTER INCORPORATED, Palo Alto, CA (US)

(72) Inventor: Timothy D. Stowe, Alameda, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/690,867

(22) Filed: Aug. 30, 2017

(65) Prior Publication Data

US 2017/0361636 A1 Dec. 21, 2017

Related U.S. Application Data

(63) Continuation of application No. 14/985,055, filed on Dec. 30, 2015, now Pat. No. 9,776,442.

(51) Int. Cl.

| | |
|---|---|
| ***B41J 33/14*** | (2006.01) |
| ***B41J 2/325*** | (2006.01) |
| ***B41J 2/455*** | (2006.01) |
| ***B41J 2/475*** | (2006.01) |

(52) U.S. Cl.

CPC ..... *B41J 33/14* (2013.01); *B41J 2/325* (2013.01); *B41J 2/455* (2013.01); *B41J 2/475* (2013.01)

(58) Field of Classification Search

CPC ... B41J 33/14; B41J 2/455; B41J 11/42; B41J 11/51; B41J 13/0009; B41J 13/0027

See application file for complete search history.

(56) References Cited

U.S. PATENT DOCUMENTS

| | | | | |
|---|---|---|---|---|
| 6,080,993 | A * | 6/2000 | Zwijsen | B41J 17/36 347/178 |
| 6,304,281 | B1 * | 10/2001 | Weichmann | B41J 2/325 347/176 |
| 6,894,713 | B2 * | 5/2005 | Moulin | B41J 2/325 347/262 |
| 7,439,995 | B2 | 10/2008 | Ali et al. | |
| 7,648,741 | B2 | 1/2010 | Nguyen et al. | |

* cited by examiner

*Primary Examiner* — Kristal Feggins
(74) *Attorney, Agent, or Firm* — Caesar Rivise, PC

(57) ABSTRACT

A system is provided for transferring a marking material from a ribbon to a substrate. The system includes a ribbon take-up device; a ribbon supply source that supplies the ribbon to the ribbon take-up device such that the ribbon is moved in a process direction; a pressure roll located between the ribbon supply source and the ribbon take-up device in the process direction, the pressure roll being configured to apply pressure to the ribbon at a pressure location when the ribbon is positioned between the pressure roll and the substrate; and a laser beam source that directs a laser beam or laser light through the pressure roll and onto the ribbon at the pressure location such that a marking portion of the ribbon is heated by the laser beams and transferred to the substrate.

20 Claims, 4 Drawing Sheets

SINGLE PASS IMAGING USING RAPIDLY ADDRESSABLE LASER LAMINATION

CROSS-REFERENCE TO RELATED APPLICATIONS

This application is a continuation of U.S. patent application Ser. No. 14/985,055, filed Dec. 30, 2015, titled "Single Pass Imaging Using Rapidly Addressable Laser Lamination".

BACKGROUND

Disclosed herein are systems and methods for transferring a marking material from a ribbon to a substrate.

Embodiments of the disclosure are well suited for transferring metallic foils and other materials from a ribbon to a substrate using digitally addressable laser.

SUMMARY

Transferring a portion of a metallic (or other) ribbon to a substrate to form a patterned metal (or other) layer of marking material is useful in various products and materials. One method of such a transfer is to feed a ribbon containing the marking material over a substrate draped over the outer periphery of a drum and then scan a laser in the cross process direction to heat the marking material such that the marking material is transferred to the substrate. An example of a device that uses this method is shown in FIGS. 1 and 2.

In FIGS. 1 and 2, a ribbon 150 is fed from a dispensing roller 160, around a pair of contact rollers 140, and to a receiving roller 170. In between the contact rollers 140, ribbon 150 is draped over an acceptor element 120, 110. Acceptor element 120, 110, is wrapped around a drum 100. An arcuate section 130 of ribbon 150 conforms to the shape of acceptor element 120, 110. A laser imaging head 180 is scanned along the direction of arrow A (the cross process direction) while it projects a laser beam onto ribbon 150 at points 190. Ribbon 150 is held against acceptor element 120, 110 under only the tension provided by contact rollers 140, dispensing roller 160, and receiving roller 170.

Single pass imaging using rapidly addressable laser lamination is a way to perform hot transfer stamping or hot foil printing in a digital fashion at much higher speeds than can currently be done with resistive thermal heads.

Embodiments of the disclosure include the recognition of deficiencies in the above example. The relatively small pressure between ribbon 150 and acceptor element 120, 110 (created by ribbon 150 being under tension) is not sufficient to result in high quality transfers at high speed. Also, the use of a scanning laser does not concentrate the laser energy sufficiently for high quality transfers at high speed.

An example of a product that can take advantage of embodiments of the disclosure is chipless RFID labels. One of the problems with the adoption of chipless RFID is that the RFID labels need to be applied and encoded (with variable data antenna structures) at high speed while the labels are being printed. Other applications of high speed foil transfer include security printing and decorative short run variable data printing at speeds greater than 0.5 m/s.

Embodiments of the disclosure provide a solution to the above problems. Embodiments of the disclosure apply pressure to a ribbon by pressing it between a pressure roller and a substrate and then directing a digitally addressable laser to the pressure location. Metallic foil ribbons require more energy to properly transfer to a substrate for at least the reason that metal spreads heat more quickly than many other materials, such as plastics, do. This is especially true for relatively thick metallic foils. The laser heating sources of embodiments of the disclosure provide a higher energy that provides a higher quality transfer.

An example of an appropriate laser for use in embodiments of the disclosure is an imaging (e.g., lithographic) apparatus including two or more spatial light modulators and associated anamorphic optical systems that modulate homogenous light and form anamorphically imaged in the process and cross-process directions, and concentrated (converged or linearly-focused) light fields in a substantially one-dimensional imaging region on a targeted scan structure (e.g., a drum roller). Each spatial light modulator (e.g., digital micromirror (DMD) devices, electro-optic diffractive modulator arrays, or arrays of thermo-optic absorber elements) includes individually addressable elements having light modulating structures that modulate (e.g., either passes or impedes/redirects) associated portions of the homogenous light according to predetermined image data. Each anamorphic optical system images and concentrates the modulated homogenous light received from an associated spatial light modulator to form an associated scan line portion, and the scan line portions formed by each anamorphic optical system collectively form the elongated scan line in the imaging region of the scan structure. Here the term anamorphic optical system refers to any system of optical lens, mirrors, or other elements that project the light from an object plane such as a pattern of light formed by a spatial light modulator, to a final imaging plane with a differing amount of magnification along orthogonal directions. Thus, for example, a square-shaped imaging pattern formed by a 2D spatial light modulator could be anamorphically projected so as to magnify its width and at same time demagnify (or bring to a concentrated focus) its height thereby transforming square shape into an image of an extremely thin elongated rectangular shape at the final image plane. By utilizing the anamorphic optical system to concentrate the modulated homogenous light, high total optical intensity (flux density) (i.e., on the order of hundreds of Watts/cm.sup.2) can be generated on any point of the scan line image without requiring a high intensity light source pass through a spatial light modulator, thereby facilitating a reliable yet high power imaging system. Furthermore, it should be clarified that the homogenous light generator, may include multiple optical elements such as light pipes or lens arrays, that reshape the light from one or more non-uniform sources of light so as to provide substantially uniform light intensity across at least one dimension of a two-dimensional light field.

Embodiments of the disclosure provide systems and methods of transferring at a high speed marking material from a ribbon to a substrate using digitally addressable lasers.

An embodiment of the disclosure may include a system for transferring a marking material from a ribbon to a substrate. The system can include a ribbon take-up device; a ribbon supply source that supplies the ribbon to the ribbon take-up device such that the ribbon is moved in a process direction; a pressure roll located between the ribbon supply source and the ribbon take-up device in the process direction, the pressure roll being configured to apply pressure to the ribbon at a pressure location when the ribbon is positioned between the pressure roll and the substrate; and a laser beam source that directs a plurality of laser beams through the pressure roll and onto the ribbon at the pressure location such that a marking portion of the ribbon is heated by the laser beams and transferred to the substrate.

Another embodiment of the disclosure may include a system for transferring a marking material from a ribbon to a substrate. The system can include a ribbon having a marking portion; a ribbon take-up device; a ribbon supply source that supplies the ribbon to the ribbon take-up device such that the ribbon is moved in a process direction; a pressure roll located between the ribbon supply source and the ribbon take-up device in the process direction, the pressure roll applying pressure to the ribbon at a pressure location when the ribbon is positioned between the pressure roll and the substrate; and a laser beam source that directs a plurality of laser beams through the pressure roll and onto the ribbon at the pressure location such that the marking portion of the ribbon is heated by the laser beams and transferred to the substrate.

Another embodiment of the disclosure may include a method of transferring a marking material from a ribbon to a substrate. The method can include applying pressure to the ribbon at a pressure location, the pressure being applied between a pressure roll and the substrate, the pressure roll being located between a ribbon supply source and a ribbon take-up device in a process direction, the pressure roll applying pressure to the ribbon at the pressure location when the ribbon is positioned between the pressure roll and the substrate; and heating a marking portion of the ribbon with a plurality of laser beams generated by a laser beam source, the laser beams being directed through the pressure roll and onto the ribbon at the pressure location such that the marking portion of the ribbon is heated and transferred to the substrate. The process direction is a direction in which the ribbon moves from the ribbon supply source to the ribbon take-up device.

Some embodiments also include the laser beam source being a digitally addressable laser beam source that is stationary in a direction perpendicular to the process direction.

Some embodiments include the pressure roll including a glass cylinder and a silicone layer applied to an outer surface of the glass cylinder such that an outer surface of the pressure roll is the silicone layer.

Some embodiments include a compensating lens positioned between the laser beam source and the pressure roll. The compensating lens alters the laser beams to compensate for distortion of the laser beams caused by the cylindrical shape of the pressure roll.

Some embodiments include the laser beams being positioned along a line at the pressure location.

DETAILED DESCRIPTION

Figure 3:
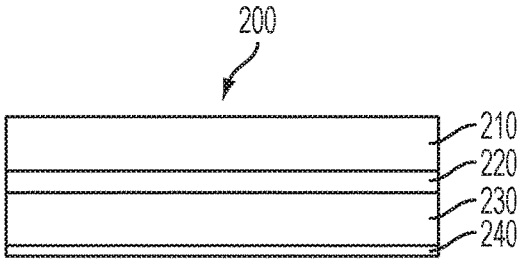
FIG. 3 is a schematic sectional view of an example of a ribbon in accordance with embodiments of the disclosure.

FIG. 3 shows an example of a ribbon 200 that can be used with embodiments of the disclosure. In FIG. 3, a functional transfer layer 230 is the primary layer of material to be transferred to the substrate. Functional transfer layer 230 can be, for example, a metallic paste, a metal film, or some other material that is to be transferred to a substrate. Directly on top of this layer is a thin laser absorption layer 220. The purpose of this layer is to absorb the laser light as close as possible to the functional transfer layer 230. The laser absorption layer 220 can contain, for example, carbon black or some other material that absorbs the energy of the lasers and heats up as a result. On top of 220 is layer 210, an optically clear structural layer which can be made from one or more optically clear materials which provide structure support (thicker than the transfer layer) but allow the laser to pass through it with minimal distortion to the path of the laser light. Layer 210 could be for example made from smooth optically transparent mylar or PEN that is 10-50 microns thick as an example. The top surface of 210 could also include a clear elastically deformable silicone material which would conform to small surface imperfections between the roller 330 and the ribbon 200, thus squeezing out any microscopic air bubbles that may cause small amounts of light scattering. A thermally activated adhesive layer 240 is shown on the lower side of functional transfer layer 230. The thermally activated adhesive layer melts at the point of heat activation by the laser and ties itself to substrate 350 when it resolidifies, providing increased adhesive strength to substrate 350. If the laser is very precisely focused and the ribbon is thin enough, resolidification of adhesive layer 240 can happen only a few 100 microns from the laser heating point, still within the pinch nip of roller 330. Example materials that can be used for the adhesive layer include hot melt adhesives with a sharp transition temperature. A release layer, not shown, can be used to help facilitate this transfer process by placing it just above the laser absorption layer 220 if it is optically clear or alternatively just between the laser absorption layer 220 and the functional transfer layer 230 to facilitate the release of the transferred portion of functional transfer layer 230 from UV absorption layer 220. The release laser can be made from a material that permanently weakens from heat exposure. For example, a layer of material that when heated decomposes partially into a gas. The use of ribbon 200 in embodiments of the disclosure will be described in the following paragraphs. The example of ribbon 200 shown in FIG. 3 is exemplary only and it is noted that other compositions and structures of ribbon can also be used with, or can be a part of, embodiments of the disclosure.

Figure 4:
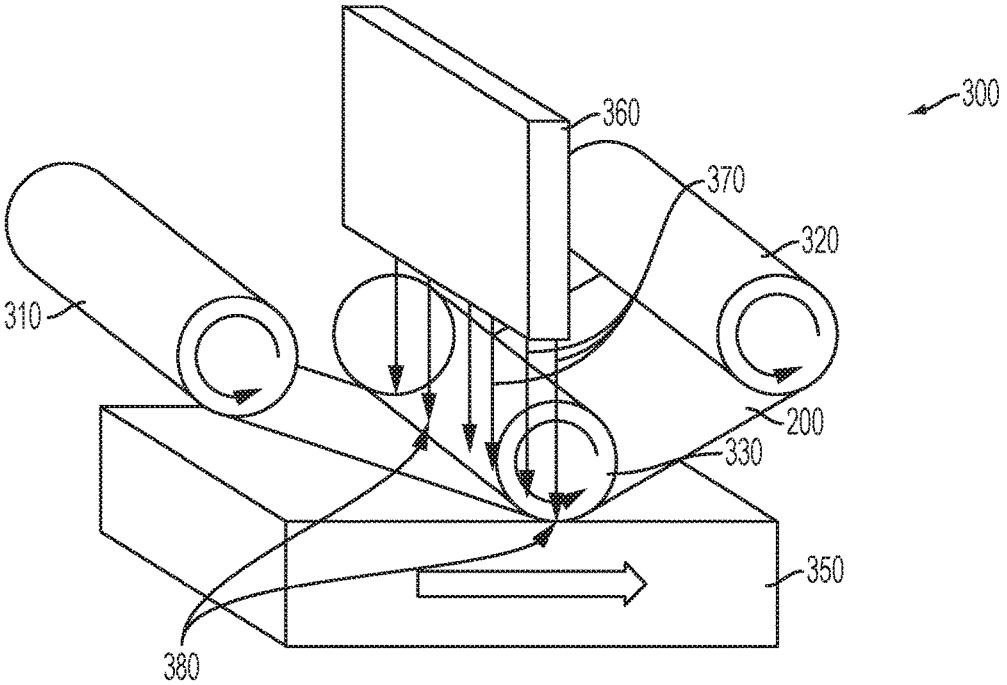
FIG. 4 is a perspective view of an example of a system in accordance with embodiments of the disclosure.

FIG. 4 shows an example of a system 300 in accordance with embodiments of the disclosure. System 300 transports ribbon 200 from a supply roll 310 to a take-up roll 320. In between supply roll 310 and take-up roll 320, ribbon 200 passes between a pressure roll 330 and a substrate 350. Substrate 350 is the product or surface onto which the marking material is transferred. As mentioned above, an example of substrate 350 is a chipless RFID label.

Ribbon 200 is subjected to pressure between pressure roll 330 and substrate 350 at nip or pressure location 380. A laser array 360 is positioned above pressure roll 330 such that laser beams 370 are projected through pressure roll 330 and onto ribbon 200 at nip 380. In order for laser beams 370 to reach nip 380, pressure roll 330 must be laser clear, i.e. optically transparent at the laser wavelength. In some embodiments, pressure roll 330 is a clear optical glass cylinder with a clear silicone outer layer.

Figure 1:
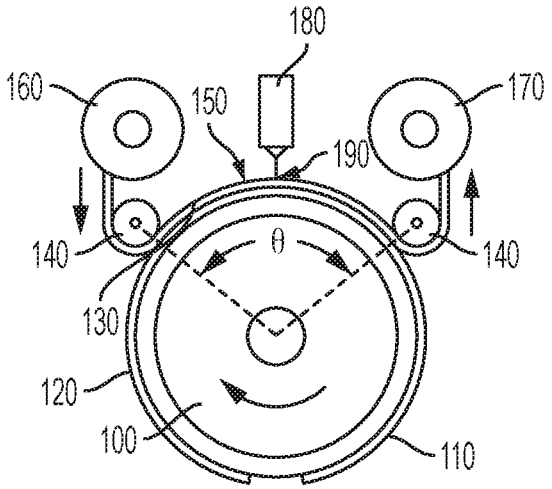
FIG. 1 RELATED ART
FIG. 1 is a schematic view of device of the related art.
Figure 2:
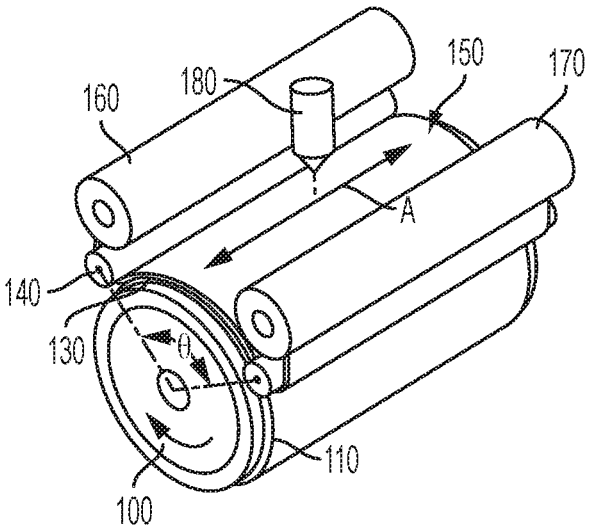
FIG. 2 RELATED ART
FIG. 2 is a perspective view of the device shown in FIG. 1.

In the system of FIG. 4, laser beams 370 heat a marking portion of functional transfer layer 230 of ribbon 200 at nip 380 to the point that the marking portion separates from the remainder of functional transfer layer 230 and adheres to substrate 350 instead of (in this example) UV absorption layer 220. By pinching ribbon 200 between pressure roll 330 and substrate 350, greater pressure can be applied to ribbon 200 than in the system shown in FIGS. 1 and 2. By subjecting ribbon 200 to the laser energy at this point of high pressure, the marking portion is better adhered to substrate 350.

In some embodiments, laser array 360 produces a very thin line of stationary laser beams 370 that are digitally controlled to turn on and off at appropriate times to form the desired pattern. Unlike the system shown in FIGS. 1 and 2, the individual lasers of laser array 360 do not move in the cross-process direction (axially along pressure roll 330).

An example of appropriate lasers are arrayed DLP lasers with a resolution of 1200 dpi, a power of approximately 160 W, and wavelengths of approximately 400 nm, 975 nm or 1064 nm. Line speeds of approximately 1 m/s to 5 m/s are possible with embodiments of the disclosure.

Figure 5:
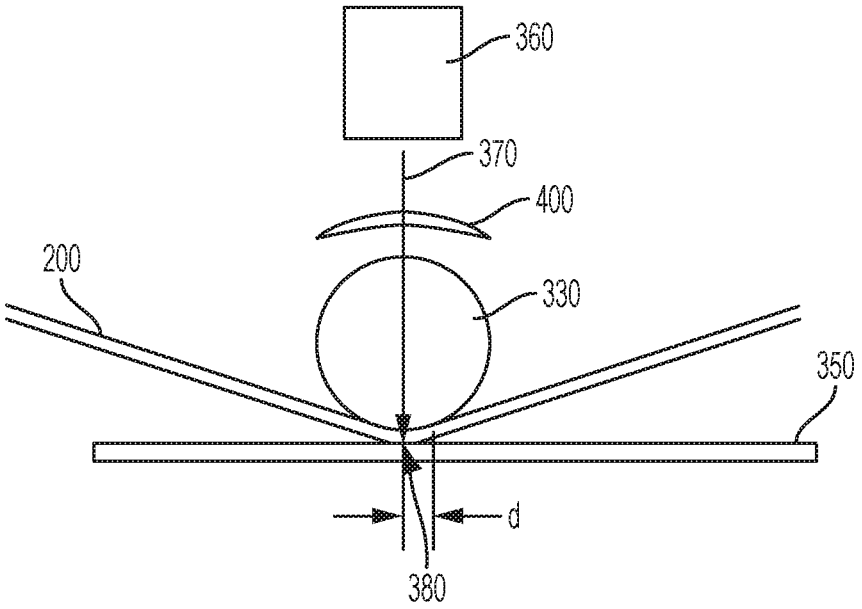
FIG. 5 is a schematic view of an example of a system in accordance with embodiments of the disclosure.

FIG. 5 shows an example of an embodiment of the disclosure similar to the system shown in FIG. 4. The example shown in FIG. 5 includes compensation optics 400 positioned between laser array 360 and pressure roll 330. The cylindrical shape of pressure roll 330 can cause laser beams 370 to be distorted. Compensation optics 400 can compensate for this distortion, resulting in a more correct placement of the laser energy at nip 380. As shown in FIG. 5, the point at which the ribbon separates from the heated and transferred material 230 can be at some small distance d away from the point where the laser heat is injected. This gives the ribbon adhesive layer 240 sufficient time to cool back down from a flowable heated state in which it makes very good surface contact as a glue to a semi-solid tacky state with sufficient adhesive strength. In some implementations this distance d can be less than a 100 microns if the ribbon is below 25 microns thick and the laser spot is below 25 microns wide.

Figure 6:
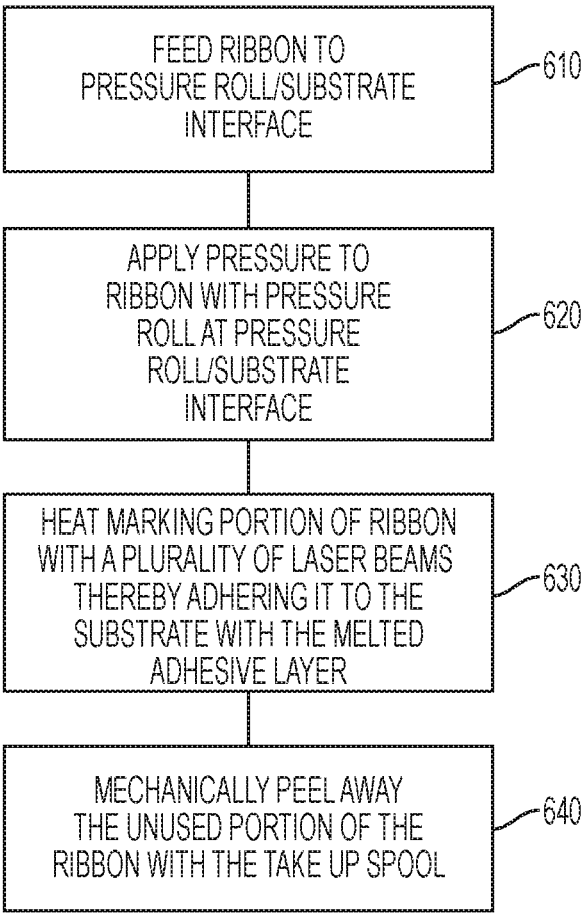
FIG. 6 is a diagram of an example of a method in accordance with embodiments of the disclosure.

FIG. 6 shows an example of a method in accordance with embodiments of the disclosure. At 610, ribbon 200 is fed to the interface between pressure roll 330 and substrate 350. At 620, pressure is applied to ribbon 200 by pressure roll 330 at the interface between pressure roll 330 and substrate 350. At 630, the marking portion of ribbon 200 is heated with a plurality of laser beams. This method results in the marking portion of ribbon 200 separating from the remainder of ribbon 200 and adhering to substrate 350 at 640. To remove the unused portion of the ribbon and support 210 from the substrate, it is finally separated under the tension from the take up roller 320 from the substrate, leaving behind only the desired functional material on the substrate.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for transferring a marking material from a ribbon to a substrate, the system comprising:

a ribbon take-up device;

a ribbon supply source that supplies the ribbon to the ribbon take-up device such that the ribbon is moved in a process direction;

a pressure roll located between the ribbon supply source and the ribbon take-up device in the process direction, the pressure roll being configured to apply pressure to the ribbon at a pressure location when the ribbon is positioned between the pressure roll and the substrate; and a laser beam source that directs a laser beam through the pressure roll and onto the ribbon at the pressure location such that a marking portion of the ribbon is heated by the laser beam and transferred to the substrate.

2. The system of claim 1, wherein the laser beam source is a digitally addressable laser beam source that is stationary in a direction perpendicular to the process direction.

3. The system of claim 2, wherein the digitally addressable laser beam source is stationary in the process direction.

4. The system of claim 3, wherein the laser beam is positioned along a line at the pressure location.

5. The system of claim 3, wherein the pressure roll includes a glass cylinder and a silicone layer applied to an outer surface of the glass cylinder such that an outer surface of the pressure roll is the silicone layer.

6. The system of claim 5, further comprising a compensating lens positioned between the laser beam source and the pressure roll, wherein the compensating lens alters the laser beam to compensate for distortion of the laser beam caused by the cylindrical shape of the pressure roll.

7. The system of claim 3, further comprising a compensating lens positioned between the laser beam source and the pressure roll, wherein the compensating lens alters the laser beam to compensate for distortion of the laser beam caused by the cylindrical shape of the pressure roll.

8. The system of claim 1, wherein the laser beam is positioned along a line at the pressure location.

9. The system of claim 1, wherein the laser beam source produces the laser beam having a power to generate heat that is sufficient to melt the adhesive layer of the ribbon thus adhering the marking portion to the substrate.

10. A system for transferring a marking material from a ribbon to a substrate, the system comprising:

a pressure roll abutting and applying pressure to the ribbon at a pressure location when the ribbon is positioned between the pressure roll and the substrate and moving in a process direction with the substrate; and a laser beam source that directs laser light having a laser wavelength through the pressure roll and onto the ribbon at the pressure location such that a marking portion of the ribbon is heated by the laser light and transferred to the substrate, wherein the pressure roll is optically transparent at the laser wavelength.

11. The system of claim 10, wherein the laser beam source is a digitally addressable laser beam source that is stationary in a direction perpendicular to the process direction.

12. The system of claim 11, wherein the ribbon includes a metallic layer and a laser clear support layer, and the marking portion of the ribbon is a portion of the metallic layer.

13. A method of transferring a marking material from a ribbon to a substrate, the method comprising:

applying pressure to the ribbon at a pressure location, the pressure being applied between a pressure roll and the substrate, the pressure roll applying pressure to the ribbon at the pressure location when the ribbon is positioned between the pressure roll and the substrate and moving in a process direction with the substrate; and heating a marking portion of the ribbon with laser light generated by a laser beam source, the laser light being directed through the pressure roll and onto the ribbon at the pressure location such that the marking portion of the ribbon is heated and transferred to the substrate, wherein the pressure roll is optically transparent at the laser wavelength.

14. The method of claim 13, wherein the laser beam source is a digitally addressable laser beam source that is stationary in a direction perpendicular to the process direction.

15. The method of claim 14, wherein the digitally addressable laser beam source is stationary in the process direction.

16. The method of claim 15, wherein the laser light is positioned along a line at the pressure location.

17. The method of claim 15, wherein the pressure roll includes a glass cylinder and a silicone layer applied to an outer surface of the glass cylinder such that an outer surface of the pressure roll is the silicone layer.

18. The method of claim 17, further comprising altering the laser light with a compensating lens positioned between the laser beam source and the pressure roll, wherein the compensating lens alters the laser light to compensate for distortion of the laser light caused by the cylindrical shape of the pressure roll.

19. The method of claim 14, wherein the ribbon includes a metallic layer and a laser clear layer, the marking portion of the ribbon is a portion of the metallic layer, and the laser light passes through the laser clear layer and heats the marking portion.

20. The method of claim 13, further comprising altering the laser light with a compensating lens positioned between the laser beam source and the pressure roll, wherein the pressure roll includes a glass cylinder and a silicone layer applied to an outer surface of the glass cylinder such that an outer surface of the pressure roll is the silicone layer, the compensating lens alters the laser light to compensate for distortion of the laser light caused by the cylindrical shape of the pressure roll, the laser beam source is a digitally addressable laser beam source that is stationary in the process direction and is stationary in a direction perpendicular to the process direction, and the laser light is positioned along a line at the pressure location.

* * * * *